US008453726B2

(12) United States Patent
Wang et al.

(10) Patent No.: US 8,453,726 B2
(45) Date of Patent: Jun. 4, 2013

(54) CORRUGATED SETTLING CUP AND A MULTI-CUP UNIFORM FLUX GAS ANCHOR

(75) Inventors: Demin Wang, Heilongjiang (CN); Yan Wang, Heilongjiang (CN); Jun Wan, Heilongjiang (CN); Shumin Zhang, Heilongjiang (CN); Rongjie Zhu, Heilongjiang (CN); Li Li, Heilongjiang (CN)

(73) Assignee: Daqing Oilfield Co., Ltd, Heilongjiang (CN)

( * ) Notice: Subject to any disclaimer, the term of this patent is extended or adjusted under 35 U.S.C. 154(b) by 241 days.

(21) Appl. No.: 12/673,064

(22) PCT Filed: Aug. 22, 2008

(86) PCT No.: PCT/CN2008/001508

§ 371 (c)(1), (2), (4) Date: May 19, 2011

(87) PCT Pub. No.: WO2009/026787

PCT Pub. Date: Mar. 5, 2009

(65) Prior Publication Data

US 2011/0209866 A1 Sep. 1, 2011

(30) Foreign Application Priority Data

Aug. 28, 2007 (CN) ..... 2007 1 0145829

(51) Int. Cl.
*E21B 43/38* (2006.01)

(52) U.S. Cl.
USPC ..... 166/105.5; 96/220

(58) Field of Classification Search
USPC ..... 166/105.5, 265; 96/176, 220
See application file for complete search history.

(56) References Cited

U.S. PATENT DOCUMENTS

| | | | | |
|---|---|---|---|---|
| 2,104,339 | A | 8/1933 | Arutunoff et al. | |
| 2,800,085 | A | 7/1957 | Hansen et al. | |
| 3,336,732 | A * | 8/1967 | Carroll | 96/206 |
| 4,231,767 | A * | 11/1980 | Acker | 96/174 |
| 4,241,788 | A | 12/1980 | Brennan | |
| 5,389,128 | A * | 2/1995 | Lopes | 96/207 |

FOREIGN PATENT DOCUMENTS

| | | | |
|---|---|---|---|
| CN | 1626770 | A * | 6/2005 |
| RU | 2077670 | C1 * | 4/1997 |
| SU | 956770 | A * | 9/1982 |

OTHER PUBLICATIONS

International Search Report for PCT/CN08/001508 mailed on Nov. 6, 2008.

* cited by examiner

*Primary Examiner* — Daniel P Stephenson
(74) *Attorney, Agent, or Firm* — Turocy & Watson, LLP

(57) ABSTRACT

A corrugated settling cup (5) is provided, wherein the cup has a cup body, an opening and a location step (52) are provided at the bottom (55) of the cup body, several location holes (53) are formed at the top of the location step (52), location projections (54) corresponding to the location holes (53) are formed at the bottom (55) of the corrugated settling cup (5), wherein the external profile of the corrugated settling cup body rises along the axial direction in a corrugated shape. A multi-cup uniform flux gas anchor is provided, wherein the gas anchor includes a central pipe (7), several corrugated settling cups (5), several settling cups protection bodies (6) and a well-flushing valve (9), wherein the external profile of the corrugated settling cup body rises along the axial direction in a corrugated shape.

6 Claims, 3 Drawing Sheets

A-A

CORRUGATED SETTLING CUP AND A MULTI-CUP UNIFORM FLUX GAS ANCHOR

TECHNICAL FIELD

The present invention relates to an oilfield downhole gas-liquid separation device, and more particularly, to a corrugated settling cup and an Iso-flow-rate Downhole Gas Separator comprising a plurality of corrugated settling cups, named a multi-cup uniform flux gas anchor.

BACKGROUND

The current oil lifting equipment available in oilfields, pumps out a three-phase mixture of gas, oil and water during its downhole operation. The gas in the mixture has a significant influence on the efficiency of the artificial lifting equipment. For example, when the submergence depth of the oil well pump is within a normal range (150~500 m), the pump efficiency is only 30-40% on average. All kinds of previously developed downhole gas-liquid separation devices, i.e., gas anchors, function as follows; a large amount of mixture is first introduced into the gas anchor, and then undergoes the gas-liquid separation in a swirling flow through various flow passages in the gas anchor. This method suffers very low separation efficiency, especially for downhole fluid with a viscosity greater than 2 mPa·s, and thus can hardly realize an objective of improving pump efficiency and increasing oil production in field applications. As yet there is no method or device that enables effective oilfield downhole gas-liquid separation when a pumping unit swabs downhole fluid, especially for fluid with a viscosity greater than 2 mPa·s. In view of this problem, the inventor has disclosed an oil well downhole gas-liquid separation method and a multi-cup uniform flux gas anchor in Chinese Patent No. 200310117207.9 which employs a principle of extending the separation time of the produced fluid, where a plurality of settling cups are installed on a central pipe. Through multi-cup flow distribution, the single-cup fluid flow rate is significantly decreased, which ensures that the settling speed of the fluid in the settling cup is greatly decreased, thereby enabling the two-phase fluid of gas and liquid to be separated in the settling cups.

However, it is known from the Stokes' Law that the gas rising speed is proportional to the square of the diameter of gas bubbles. The settling cup used in the Patent 200310117207.9 has a smooth external surface, and extends in a streamlined profile, such that small gas bubbles are evenly distributed along the external side of the cup, and are less likely to contact each other, which does not facilitate aggregation of the small gas bubbles.

SUMMARY OF THE INVENTION

The main purpose of the present invention is to provide a corrugated settling cup and a multi-cup uniform flux gas anchor comprising a plurality of the corrugated settling cups, which can improve degassing efficiency, minimize gas content in a fluid pulled out by an oil well pump, and therefore increase oil production and achieve energy savings and consumption reduction.

In order to achieve the above object, the present invention provides a corrugated settling cup comprising a cup body, wherein the bottom of the cup body is open and provided with a locating step, a top of the locating step is provided with a plurality of locating holes, and a bottom of the settling cup is provided with locating protrusions corresponding to the locating holes, and wherein an external profile of the cup body rises in a corrugated shape along the axial direction of the cup body.

The corrugated settling cup as mentioned above, wherein an angle at which the external profile thereof rises in a corrugated shape along the axial direction, is 30°~60° with respect to the axial direction, and the number of ridges thereof is 6~18.

Additionally, the present invention provides a multi-cup uniform flux gas anchor, mainly comprising a central pipe, a plurality of corrugated settling cups, a plurality of settling cup protectors and a well-flushing valve, wherein the plurality of settling cup protectors are slipped onto the central pipe in clearance fit and the plurality of corrugated settling cups are slipped onto the central pipe in clearance fit between every two settling cup protectors, a plurality of liquid inlet holes are located evenly on the central pipe at a position close to an inner bottom of each corrugated settling cup, a lower portion of the central pipe is connected to the well-flushing valve, and the external profile of the cup body of the corrugated settling cups rises in a corrugated shape along the axial direction of the cup body.

The multi-cup uniform flux gas anchor as mentioned above, wherein an angle at which the external profile of the corrugated settling cup rises in a corrugated shape along the axial direction, is 30°~60° with respect to the axial direction, and the number of ridges thereof is 6~18.

The multi-cup uniform flux gas anchor as mentioned above, wherein the number of the corrugated settling cups is 30~500.

The multi-cup uniform flux gas anchor as mentioned above, wherein the flow area of the liquid inlet hole is 0.2 $mm^2$~7 $mm^2$.

By applying the above mentioned technical solutions, the present invention has the following advantages:

The gas-liquid mixture is divided into a number of portions by the plurality of settling cups, and by the external profile rising in a corrugated shape, the separated gas rapidly aggregates and rises up, thereby achieving effective gas-liquid separation.

Each pump suction stroke sucks in all the fluid at the bottom of the settling cups. The liquid volume pumped each time by the oil well pump is not greater than one half of the total volume of the settling cups, and the liquid inlet amount passing through each liquid inlet hole is approximately the same, thereby ensuring sufficient and effective gas-liquid separation in the settling cups.

The invention overcomes existing defects in various prior art gas anchors, and specifically solves the problem of gas-liquid separation for oil well downhole fluid with a viscosity greater than or equal to 2 mPa·s, minimizes gas content in the fluid pulled out by the oil well pump, and therefore achieves the object of increasing pump efficiency and oil production, as well as saving energy and reducing consumption.

In order to describe the present invention in more detail, preferred embodiments and description of the drawings are listed below.

DETAIL DESCRIPTION OF THE EMBODIMENTS

The present invention is an improvement on the basis of the Chinese Patent Application No. 200310117207.9.

Figure 1:
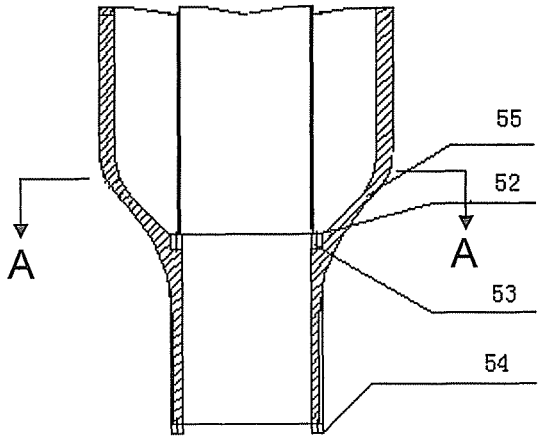
FIG. 1 is a cross-sectional view showing a front view structure of the corrugated settling cup of the present invention.
Figure 2:
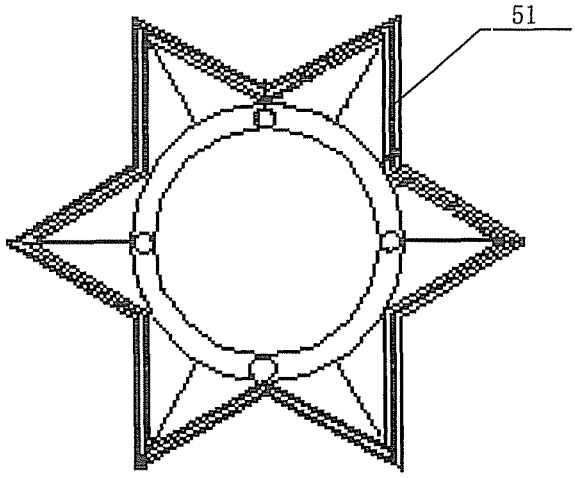
FIG. 2 is a cross-sectional view showing a top view structure of the corrugated settling cup of the present invention taken along line A-A of FIG. 1.
Figure 3:
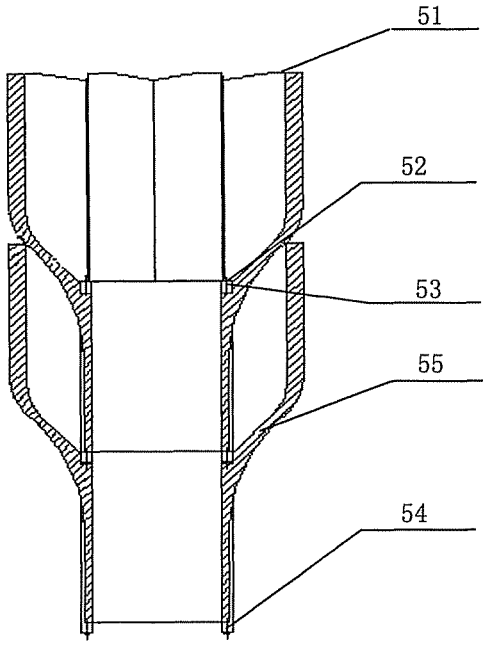
FIG. 3 is a schematic illustration showing the combination structure of two corrugated settling cups of the present invention.

As shown in FIG. 1 to FIG. 3, the present invention firstly discloses a corrugated settling cup 5 used in a multi-cup uniform flux gas anchor, which has a cup body. The upper portion 51 of the cup body is a corrugated polygon which is in the shape of a star. The lower portion 55 of the cup body is a downwardly converging frustum with corresponding shape. A plurality of ridges are provided on the inner wall of the frustum and are at an angle of 30°~60° with respect to an axial direction of the cup body. The upper portion 51 of the cup body is connected to the ridges on the lower portion 55 of the cup body through plane transition. The number of the ridges on the cup body is 6~18. As a result, the external profile of the cup body rises in a corrugated shape along the axial direction. The bottom of the cup body is open and provided with a locating step 52, the top of which is provided with a plurality of locating holes 53. The bottom of the settling cup is provided with locating protrusions 54 fitted with and in equal number to the locating holes. When a plurality of corrugated settling cups 5 are superimposed for application, the locating protrusions 54 of an upper corrugated settling cup 5 are inserted into the locating holes 53 of an adjacent lower corrugated settling cup 5.

Figure 4:
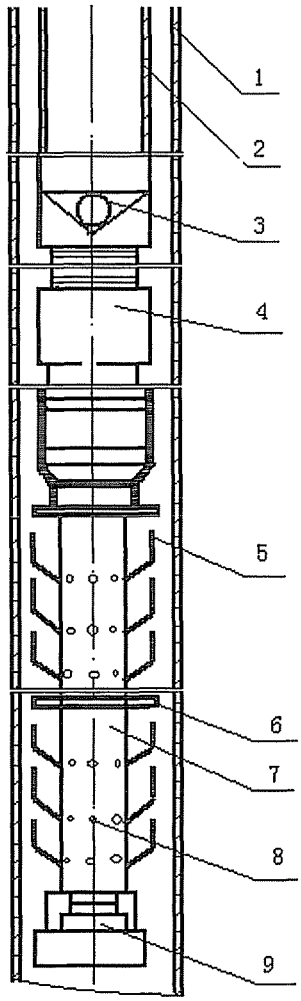
FIG. 4 is a schematic illustration showing the pipe string structure of the multi-cup uniform flux gas anchor of the present invention.

As shown in FIG. 4, the multi-cup uniform flux gas anchor of the present invention mainly comprises a central pipe 7, a plurality of corrugated settling cups 5, a plurality of settling cup protectors 6 and a well-flushing valve 9. The plurality of settling cup protectors 6 are slipped onto the central pipe 7 in clearance fit. An outer diameter of an upper tray of the settling cup protector 6 is larger than a mouth diameter of the corrugated settling cup 5, and is the largest outer diameter of the gas anchor. The plurality of corrugated settling cups 5 are slipped onto the central pipe 7 in clearance fit between every two settling cup protectors 6, and the total installation number of the corrugated settling cups may be 30~500. 4~10 liquid inlet holes 8 are located evenly on the central pipe 7 at a position close to the inner bottom of each corrugated settling cup 5. The flow area of the liquid inlet hole 8 is 0.2 $mm^2$~7 $mm^2$. The lower portion of the central pipe 7 is connected to the well-flushing valve 9.

As shown in FIGS. 1-4, the present invention can be implemented with the above technical solutions as follows. Firstly, slip a plurality of corrugated settling cups 5 onto the central pipe 7, and allow the locating protrusions 54 of an upper corrugated settling cup 5 to be inserted into the locating holes 53 of an adjacent lower corrugated settling cup 5; then, fix a plurality of settling cup protectors 6 onto the central pipe 7 with screws (not shown), and make the settling cup protectors 6 engaged with the central pipe 7 in clearance fit; thereafter, connect an oil well pump 3 and the gas anchor with a connector 4, where the connector 4 is a nipple, with one end having a 2⅞ TBG or 3½ TBG tubing thread for connection with the oil well pump 3 and the other end having a 2⅞ TBG tubing thread for connection with the gas anchor; finally, insert the above assembly into a well casing 1.

In the present embodiment, the outer diameter of the settling cup protector 6 is ϕ114 mm (the largest outer diameter for general downhole tools in the ϕ140 mm casing), the outer diameter of the corrugated settling cup 5 is ϕ110 mm, and the well-flushing valve 9 can be a screwed plug.

During each swabbing of the oil well pump 3, to ensure that during the swabbing interval of the oil well pump 3, the fluid entering the central pipe 7 through the liquid inlet holes 8 has enough time for sufficient separation in each corrugated settling cup 5, it is required that the total liquid inlet amount of all the liquid inlet holes 8 is not great than one half of the total volume of all the corrugated settling cups 5, and that the liquid inlet amount through each liquid inlet hole 8 on the central pipe 7 is approximately the same. The above requirements can be met by changing the flow area and the number of liquid inlet holes 8, as well as the number of corrugated settling cups 5. Reference is made to the Chinese Patent No. 200310117207.9 for specific methods.

During the operation of the oil well pump 3, the gas-liquid mixture can only enter the oil well pump 3 through the settling cups 5 and the liquid inlet holes 8 due to the blockage of the well-flushing valve 9. Due to the flow restriction effect of the liquid inlet holes 8, there is enough time for gas to be separated from the gas-liquid mixture. Due to the effect of the corrugated inclined surfaces of the corrugated settling cups 5, small gas bubbles aggregate toward the corrugation ridges. Gas bubbles are distributed along the 6~18 corrugation ridges, which greatly increases the chances for gas bubbles to contact each other. Small gas bubbles aggregate into large ones, whereby increasing the gas rising speed in the liquid. Accordingly, the separated gas rapidly aggregates and rises up along the outer wall of the settling cups, and is separated into the annular space between the oil pipe 2 (connected with the oil well pump 3) and the casing 1, and is then discharged. The separated liquid is expelled through the oil well pump 3 and the oil pipe 2.

The multi-settling cup uniform flux gas anchor of the present invention was field-tested on Sep. 12, 2006 in Daqing Oilfield Co. Ltd. Production data obtained before and after the test are shown in the following table.

Test data of the multi-settling cup uniform flux gas anchor

| Item | Liquid production (t/d) | Casing pressure (MPa) | Submergence depth (m) | Pump efficiency (%) | Downhole Operation Time |
|---|---|---|---|---|---|
| Before gas anchor used | 48.9 | 1.22 | 351.4 | 40.6 | Oct. 30, 2003 |
| After comparative prior art gas anchor used | 64.0 | 0.8 | 233.5 | 53.1 | Nov. 7, 2003 |
| After gas anchor of present invention used | 70.2 | 0.75 | 158.3 | 58.2 | Sep. 12, 2006 |

-continued

Test data of the multi-settling cup uniform flux gas anchor

| Item | Liquid production (t/d) | Casing pressure (MPa) | Submergence depth (m) | Pump efficiency (%) | Downhole Operation Time |
|---|---|---|---|---|---|
| Value difference before vs. after gas anchor of present invention used | +15.1 | −0.42 | −213.1 | 17.6 | |
| Value difference between gas anchors used, present invention vs. comparative prior art | 6.2 | −0.05 | −72.5 | +5.1 | |

In the above table, the comparative prior art gas anchor refers to the multi-cup uniform flux gas anchor disclosed by the inventor in the Chinese Patent No. 200310117207.9. It can be seen from the table that, in comparison with the prior art gas anchor, the present novel multi-settling cup uniform flux gas anchor increases the pump efficiency by 5.1 percent, increases the daily liquid production by 6.2 tons, and decreases the submergence depth by 75.2 meters. The testing effect is significantly better than that before the improvement.

With the improved settling cups, small gas bubbles aggregate toward the corrugation ridges, and gas bubbles are distributed along the 6~18 corrugation ridges, whereby greatly increasing the chance of gas bubbles contacting each other. Small gas bubbles aggregate into large ones, whereby increasing the gas rising speed in the liquid. Accordingly, the submergence depth of the testing oil well is decreased and pump efficiency is improved.

In addition, the multi-settling cup uniform flux gas anchor of the present invention can be used with other artificial lifting devices in a set, such as a screw pump, to realize gas-liquid separation and increase pumping efficiency.

INDUSTRIAL APPLICABILITY

The present invention provides a multi-settling cup uniform flux gas anchor, in which the settling cups are made in a rising corrugated shape. This can make the separated gas rapidly aggregate and rise up, thereby achieving the object of effective gas-liquid separation. The present invention can be used with other artificial lifting devices to realize gas-liquid separation and increase pumping efficiency, and is suitable for industrial manufacture and for application in the field of oil recovery.

All the above-disclosures are merely preferred embodiments of the present invention, but are not intended to limit the present invention. Various other equivalent modifications or replacements without departing from scope of the present invention should be included in the scope of the invention, including those which can be used with other artificial lifting devices in a set, such as a screw pump, to realize gas-liquid separation and increase pumping efficiency.

The invention claimed is:

1. A corrugated settling cup comprising a cup body, wherein a bottom of the cup body is open and provided with a locating step, the top of the locating step is provided with a plurality of locating holes, and the bottom of the settling cup is provided with locating protrusions corresponding to the locating holes, and wherein an external profile of the cup body rises in a corrugated shape along an axial direction of the cup body.

2. The corrugated settling cup as defined in claim 1, wherein an angle at which a lower portion of the cup body rises in a corrugated shape along the axial direction, is 30°~60° with respect to the axial direction, and the number of ridges thereof is 6~18.

3. A multi-cup uniform flux gas anchor, comprising a central pipe, a plurality of corrugated settling cups, a plurality of settling cup protectors and a well-flushing valve, wherein the plurality of settling cup protectors are slipped onto the central pipe in clearance fit and the plurality of corrugated settling cups are slipped onto the central pipe in clearance fit between every two settling cup protectors, a plurality of liquid inlet holes are located evenly on the central pipe at a position close to an inner bottom of each corrugated settling cup, a lower portion of the central pipe is connected to the well-flushing valve, wherein an external profile of the cup body of the corrugated settling cups rises in a corrugated shape along an axial direction of the cup body, and wherein an angle at which a lower portion of the cup body rises in a corrugated shape along the axial direction is 30°~60° with respect to the axial direction, and the number of ridges thereof is 6~18.

4. The multi-cup uniform flux gas anchor as defined in claim 3, wherein the number of corrugated settling cups is 30~500.

5. The multi-cup uniform flux gas anchor as defined in claim 3, wherein the flow area of the liquid inlet hole is 0.2 $mm^2$~7 $mm^2$.

6. The multi-cup uniform flux gas anchor as defined in claim 4, wherein the flow area of the liquid inlet hole is 0.2 $mm^2$~7 $mm^2$.

* * * * *